US006128890A

United States Patent [19]

Firth

[11] Patent Number: 6,128,890

[45] Date of Patent: Oct. 10, 2000

[54] WASTE STORAGE DEVICE

[75] Inventor: Robert Firth, Bradford, United Kingdom

[73] Assignee: Sangenic International Limited, Mansfield, United Kingdom

[21] Appl. No.: 09/241,062

[22] Filed: Feb. 1, 1999

[30] Foreign Application Priority Data

Feb. 9, 1998 [GB] United Kingdom ..... 9802738

[51] Int. Cl.[7] ..... B65B 9/15

[52] U.S. Cl. ..... 53/567; 53/390; 53/576; 83/649; 83/946; 220/277; 220/908.1

[58] Field of Search ..... 53/390, 549, 567, 53/576; 83/649, 946; 220/277, 908.1

[56] References Cited

U.S. PATENT DOCUMENTS

| | | | |
|---|---|---|---|
| 3,452,368 | 7/1969 | Couper | 53/567 |
| 4,869,049 | 9/1989 | Richards et al. . | |
| 5,590,512 | 1/1997 | Richards et al. . | |
| 5,651,231 | 7/1997 | Garland | 53/570 |
| 5,655,680 | 8/1997 | Asbach et al. | 220/908.1 |
| 5,765,339 | 6/1998 | Garland | 53/390 |
| 5,813,200 | 9/1998 | Jacoby et al. | 53/567 |

FOREIGN PATENT DOCUMENTS

| | | |
|---|---|---|
| 2 206 094 | 12/1988 | United Kingdom . |
| 2 292 725 | 3/1996 | United Kingdom . |

*Primary Examiner*—John Sipos
*Attorney, Agent, or Firm*—Shoemaker & Mattare

[57] ABSTRACT

The Invention provides a waste storage device comprising a main body and a lid, the main body including a waste aperture inlet arranged to receive a storage bag, the lid comprising storage bag severing means movably mounted thereon and a formation arranged to hold the storage bag against movement relative to the lid when the lid is in a closed position, for operation of the severing means, in which the lid is movably fastened to the main body between said closed position and an open position.

8 Claims, 7 Drawing Sheets

WASTE STORAGE DEVICE

FIELD OF THE INVENTION

The invention relates to a waste storage device and a method of operation of such a device.

DESCRIPTION OF THE PRIOR ART

One known waste storage device is disclosed in GB Patent No. 2206094 and U.S. Pat. No. 4,869,049 (the contents of which are incorporated herein by reference) and described here with reference to FIG. 1. The device is particularly useful for the storage for subsequent disposal of waste such as babies nappies or other personal waste material. A plastics container 21 is formed with an internal flange 22 from which a cylinder 23 extends upwards. A pack consisting of a tubular core 1 inside a profusely circumferentially pleated length of flexible tubing 2 is located in the container 21 with the core 1 resting on the flange 22 and rotatable on the cylinder 23. To begin using the pack to form a series of packages of objects, which in this particular example will be considered to be babies' disposable nappies, the top of the flexible tubing 2 is pulled upwards and tied into a knot 24. This closed end can then form the bottom of a package to be formed along the length of part of the tubing. This is effected by pushing the closed end downwards inside the core 1 and cylinder 23 by the object to be packaged. As this is being done the flexible tubing 2 from the pleated length slides over the top edge 25 (FIG. 1) of the core 1 which is made sufficiently smooth to prevent the flexible tubing from being damaged. The core I may be approximately four inches (10.16 cm) diameter but, of course, the diameter of the flexible tubing 2 is substantially more than this.

When the object has been thrust well into the concentric core 1 and cylinder 23, the package is closed by twisting the flexible tubing 2 above the object as at 30 (FIG. 1). This is done by turning the core 1 with remaining pleated tubing thereon about the core axis. A unit 31 is formed for this purpose in that it has a depending annular flange 50 formed with an outer surface that is a taper fit in a frusto-conical inner surface 51 at the top of the core 1. The package is prevented from turning about the axis of the core during this manual twisting action by springs 52 fixed to the container 21 and projecting radially inwards to engage the package. These springs are equidistantly spaced round the container 21. Shallow, grooves dividing upwardly extending ridges are formed on the frusto-conical inner surface 51 to stop slippage of the flexible tubing during the twisting operation.

By the aforesaid means, a series of connected closed packages 35 are formed and this can be continued until the pleated tubing 2 is exhausted. In the arrangement of FIG. 1 the packages collect in a bin portion 36 of the container closed at the bottom by a hinged base 53 normally held closed by a manually operable catch of suitable type. When it is desired to remove the packages from the bin portion 36 for transport to a waste disposal facility, the uppermost package is severed above its upper twisted closure 30 and the hinged base 52 opened for the removal of the packages through the end of the bin portion. Even if the twisted seals between the packages become loosened, the lid and the newly formed topmost twisted seal which prevent the escape of odours, vapours and gases to the ambient atmosphere. However, it has been found that when the tubing 2 is made of high density polyethylene the twisted joints remain remarkably tight.

A development of this arrangement is disclosed in GB 2292725 and U.S. Pat. No. 5,590,512 (the contents of which are incorporated herein by reference) and described here with reference to FIG. 2. It will be seen that an outwardly flared funnel 12 having an inlet edge 15 is detachably connected to the top of the core 1 by a taper joint 16. The funnel improves the hygiene of the device yet further because the flexible tubing 2 is drawn from the pack as an object is pushed down, over the inlet edge 15 of the funnel 12 to present a fresh and hygienic layer of tubing in the flared part of the funnel. The funnel 12 is twisted to obtain the twisted closure 30. An alternative spring arrangement 14 is shown in FIG. 2 and described filly in GB2292725.

GB 2206094 and GB 2292725 both additionally disclose a cutting arrangement for severing the tubing when it is desired to remove the packages for disposal. Referring, to FIG. 3, the severing means is incorporated in the unit 31 which is a bipartite unit comprising an outer ring 55 formed with a flange 50 that locks into the top of the core 1 or funnel 12 and a disc 56 which is freely rotatable in the ring 55. The disc 56 comprises a circular transparent sheet 57, through which the user can see the twisted flexible tubing, set in an angle section ring having a horizontal flange 58 and a vertical flange 59 (FIG. 1) located between narrow flanges inside the relatively stationary flange 50. In the angle of the ring 58, 59 three finger pieces 60 are fixed 120° apart above the transparent sheet 57. A cutter unit 61 is fixed beneath the flange 58,. This device has an upper arcuate part 62 and a lower tapered shoe 63 with a gap between them along the major portion of their length. Close to the closed termination of this gap a metal cutter blade 64 is fixed as close as possible to the relatively stationary flange 50 so that the blade is shrouded against doing any damage to a person's fingers when the lid 31 is removed. The predominant material for the lid may be plastics material or metal.

To operate the cutter unit 61, the disc 56 is turned by means of the finger pieces 60 or any other suitable finger pieces through a full revolution. In this movement the tapered shoe 63 pierces through the radially pleated taut portion 65 of the flexible tubing that flares outwards from the topmost twist 30 to the core 1. Further rotation of the disc 56 causes the cutter blade 64 to cut round the tubing material, cleanly separating the uppermost package from the flexible tubing remaining on the core 1.

These known cutting arrangements are however relatively cumbersome, complex and/or can be lost or misplaced.

SUMMARY OF THE INVENTION

According to the invention there is provided a waste storage device comprising a main body and a lid, the main body including a waste aperture inlet arranged to receive a storage bag, the lid comprising storage bag severing means movably mounted thereon and a formation arranged to hold the storage bag against movement relative to the lid when the lid is in a closed position, for operation of the severing means, in which the lid is movably fastened to the main body between said closed position and an open position. As a result there is no risk of misplacing the severing means, the number of steps in the cutting operation are reduced and a greater level of hygiene is afforded.

Preferably the lid is guided between said open and closed positions by the movable fastening, allowing simple location of the severing means. The lid may be hinged to the main body, allowing a simple movable fastening.

The waste inlet aperture may include an outwardly flared upper end enclosed by the lid in the closed position, allowing increased hygiene on insertion of waste and enclosure of the entire waste inlet aperture.

The lid further preferably includes detent means releasably fixing the severing means against movement relative to the lid making the device secure and tamper-proof The severing means may be rotatably mounted on the lid.

The formation on the lid may be arranged to hold the storage bag against the waste inlet aperture in the closed position.

The storage bag may be formed from a length of flexible tubing drawn from a pack as waste is thrust through the waste inlet aperture, the pack being rotatable relative to the main body to form a closure about the waste by twisting.

According to the invention there is further provided a method of storing waste in a waste storage device as hereinbefore defined in which a waste storage bag is positioned extending through the waste inlet aperture, the method comprising the steps of opening the lid, placing waste in the storage bag and closing the lid, in which, when it is desired to sever the storage bag the severing means is moved relative to the lid and the bag to sever the bag.

According to the invention there is yet further provided a waste storage device comprising a main body and a lid, the main body including a waste aperture inlet arranged to receive a storage bag, the waste aperture inlet including an outwardly flared portion and the lid being hinged to the main body between an open position and a closed position enclosing the outwardly flared portion of the waste aperture inlet.

DESCRIPTION OF THE DRAWINGS

An embodiment of the invention will now be described, by way of example, with reference to the drawings, of which.

DESCRIPTION OF THE PREFERRED EMBODIMENTS

Referring now to FIGS. 4 to 7, an embodiment of the invention is now described in more detail. Features common with the embodiments described with reference to FIGS. 1 to 3 are referenced with like numerals and their description will not be repeated except where necessary.

Figure 1:
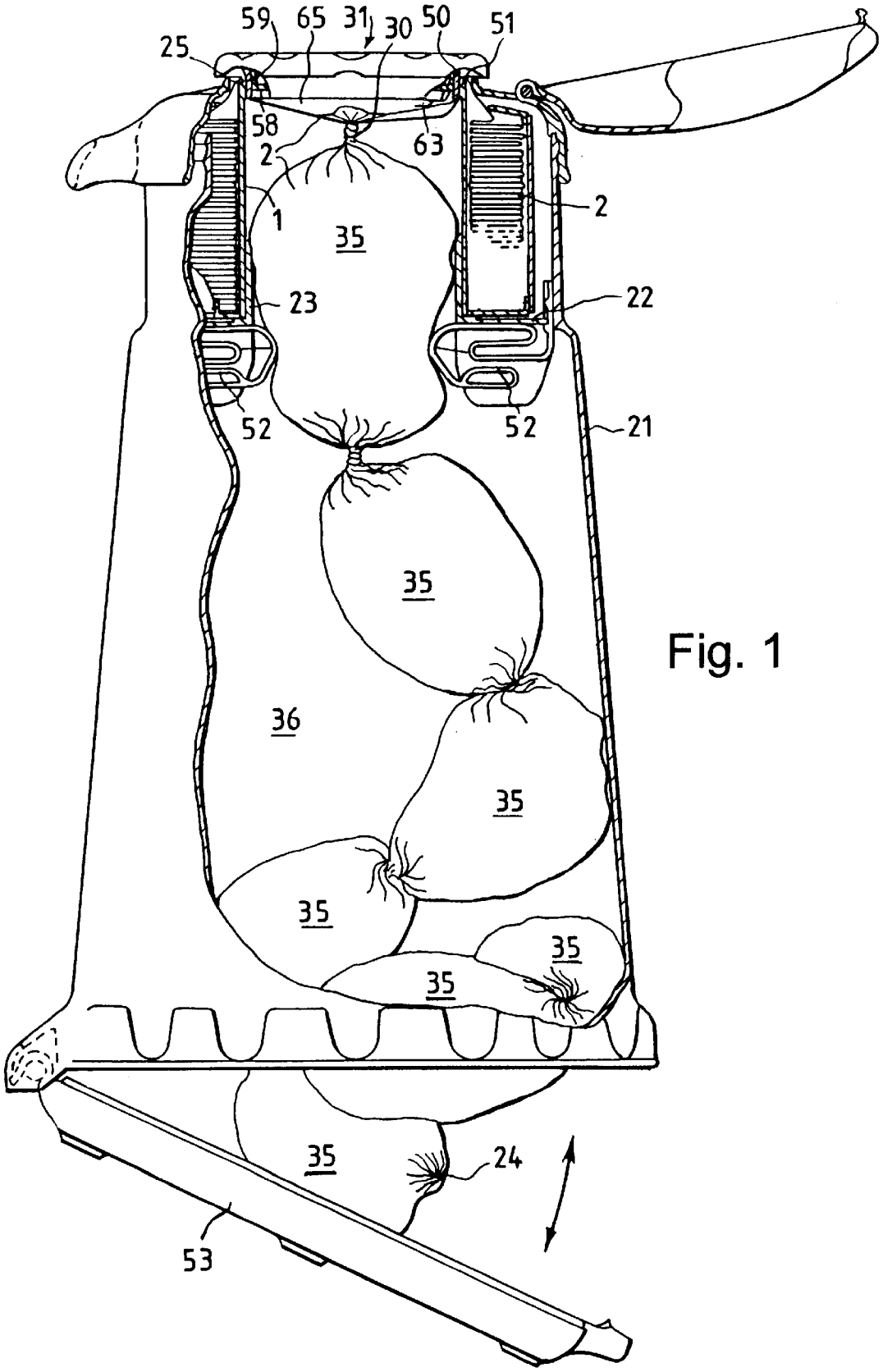
FIG. 1 is a partially cut-away side view of a device of known type.
Figure 2:
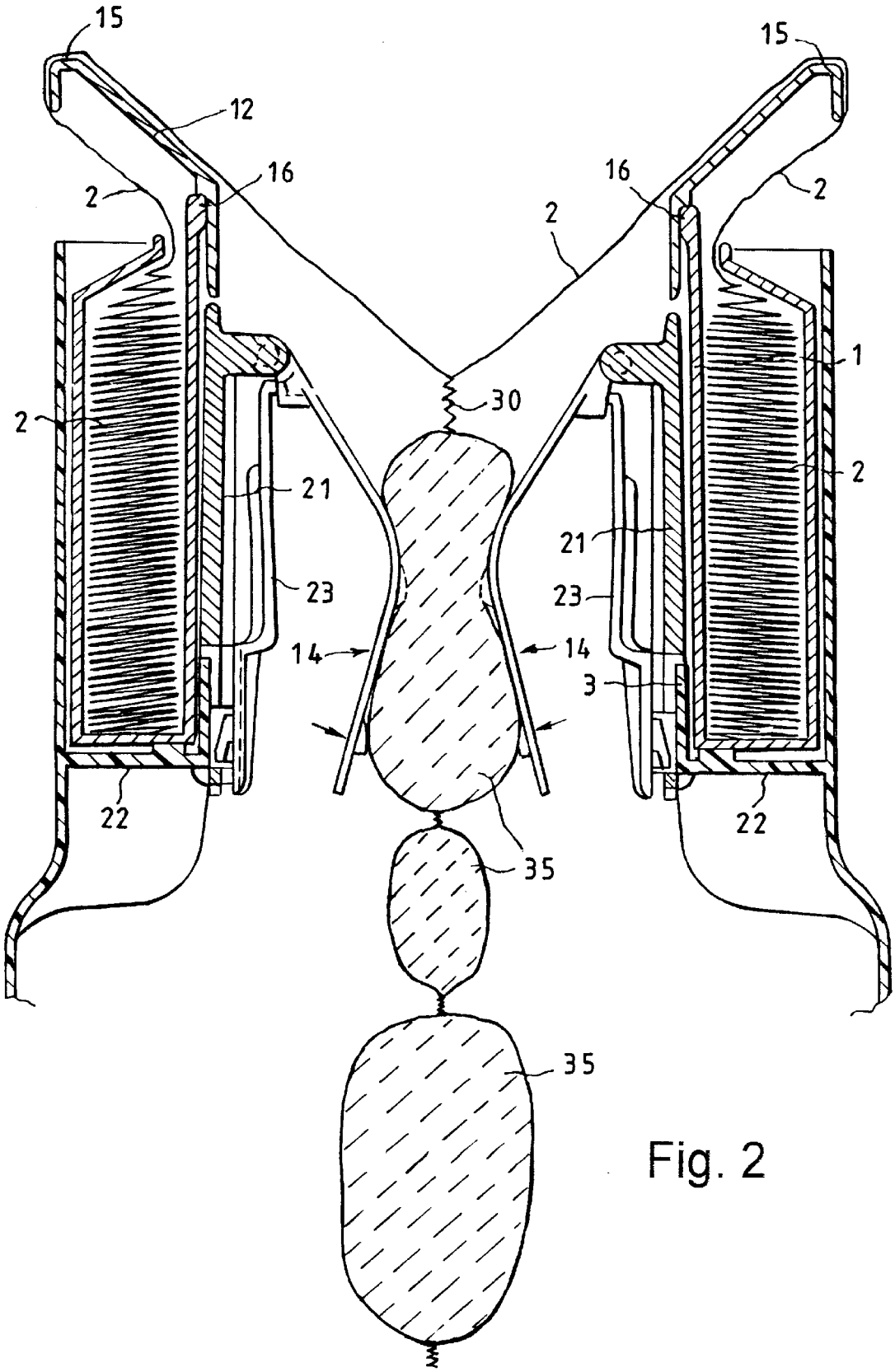
FIG. 2 is a partial sectional side view of another device of known type.
Figure 3:
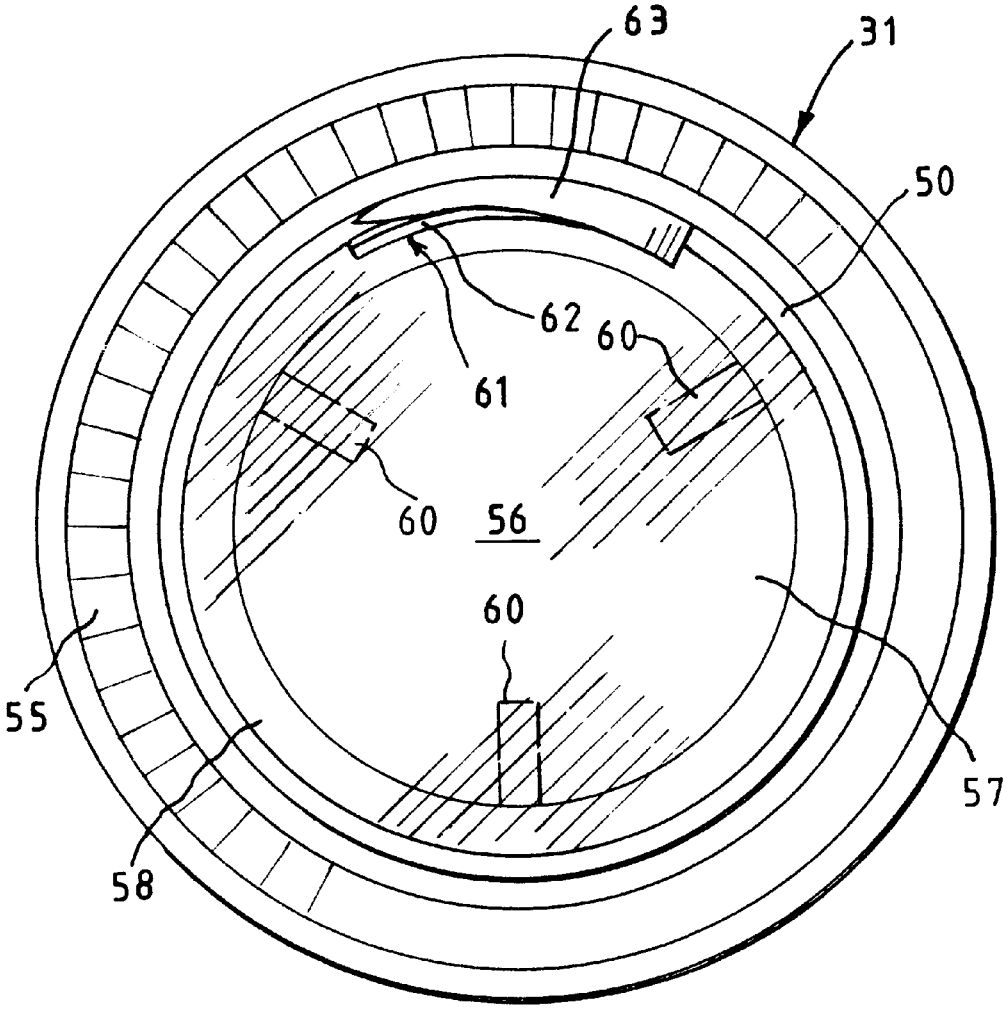
FIG. 3 is an underneath plan view of a cutting device of known type.
Figure 4:
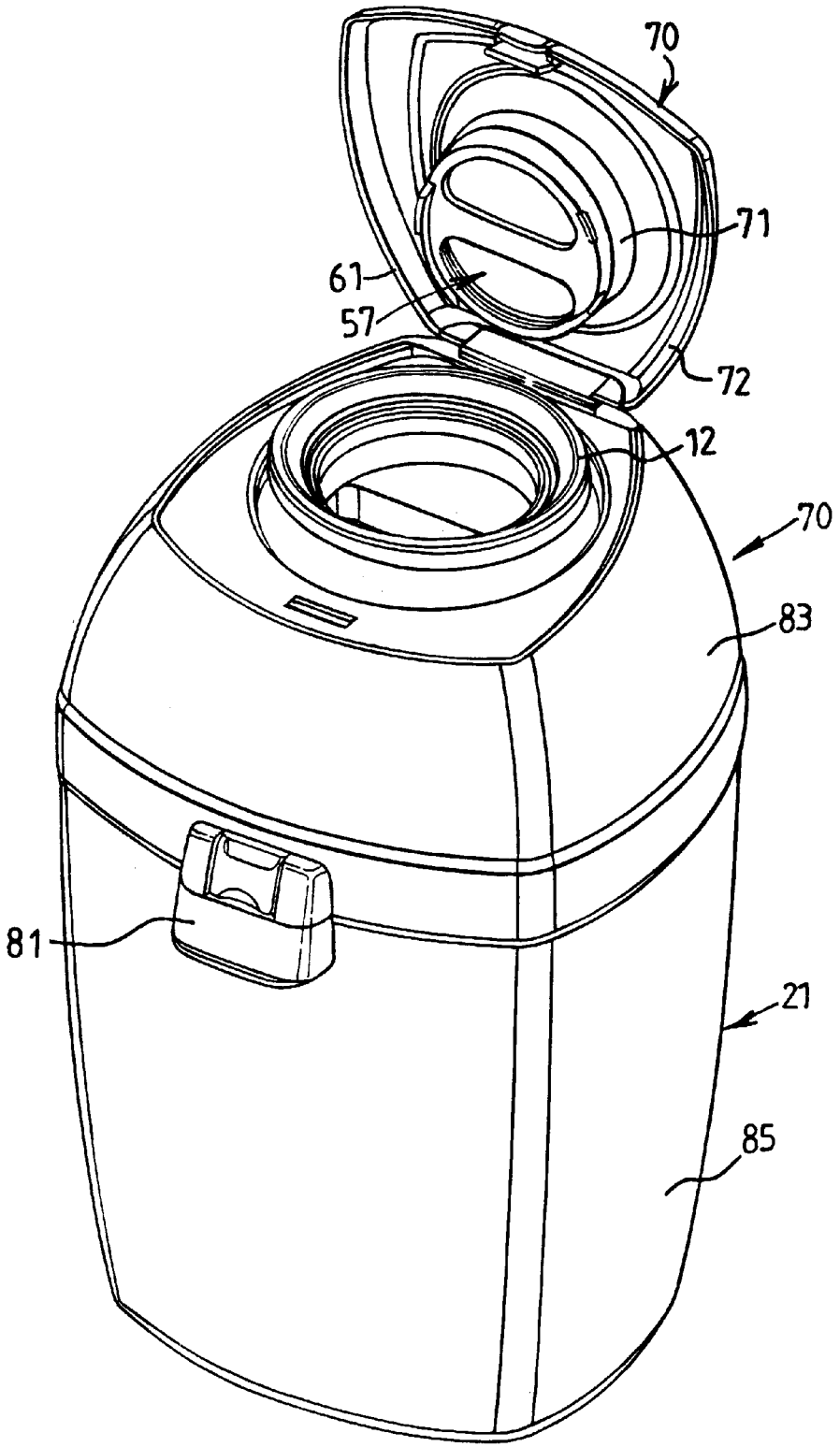
FIG. 4 is a perspective view of an embodiment of the invention in a first configuration.

The device comprises a plastics container 21 generally corresponding to that shown in FIGS. 1 to 3, in particular including a pack from which flexible tubing can be drawn out, and springs for holding an object against twisting to form a series of packages separated by twisted closures. A funnel 12 is detachably fixed to the pack as discussed in relation to FIG. 3. The container 21 hinges intermediate its top and bottom allowing it to be opened to remove waste—a releasable catch 80 is preferably provided allowing the container to be held closed in general use. The container may, alternatively, open at its base in a known manner.

The device further includes a lid 70 on which a severing arrangement or cutter assembly designed generally as 72 is mounted. The lid 70 is hinged to the container 21 by a hinge mechanism of any suitable type, and may be permanently or detachably fixed by the hinge. The lid is preferably also of plastics material.

Figure 5A:
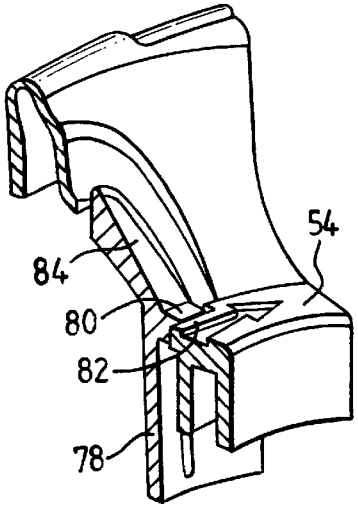
FIG. 5*a* is a sectional perspective view of a detail of the embodiment of FIG. 4 at a first stage of operation.
Figure 5B:
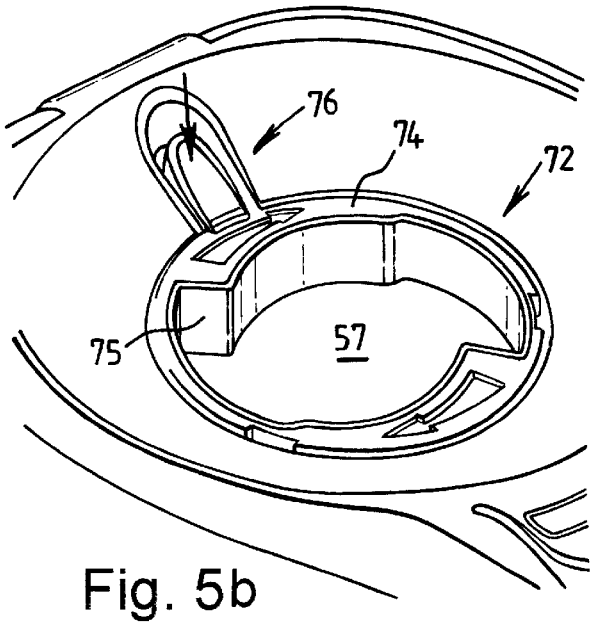
FIG. 5*b* is a partial perspective view corresponding to FIG. 5*a;*
Figure 6A:
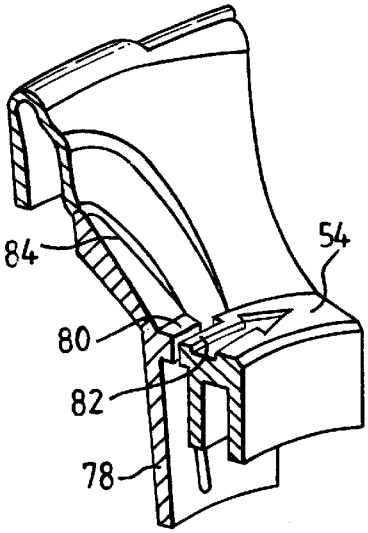
FIG. 6*a* is a sectional perspective view of a detail of the embodiment of FIG. 4 at a second stage of operation.
Figure 6B:
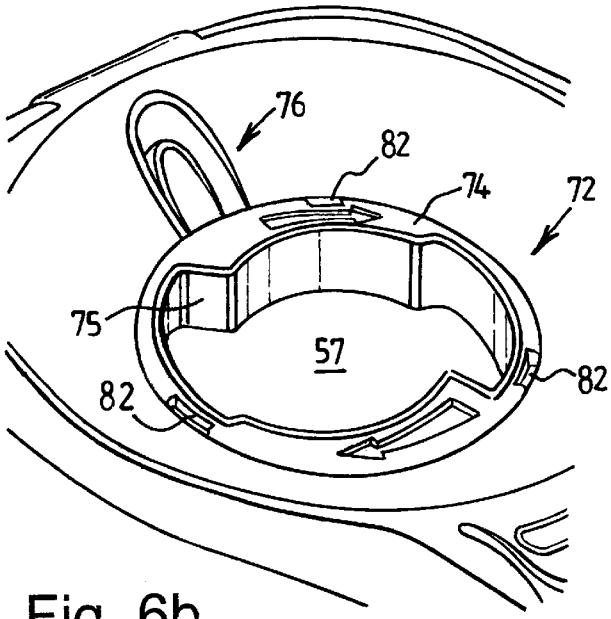
FIG. 6*b* is a partial perspective view corresponding to FIG. 6*a;*
Figure 7A:
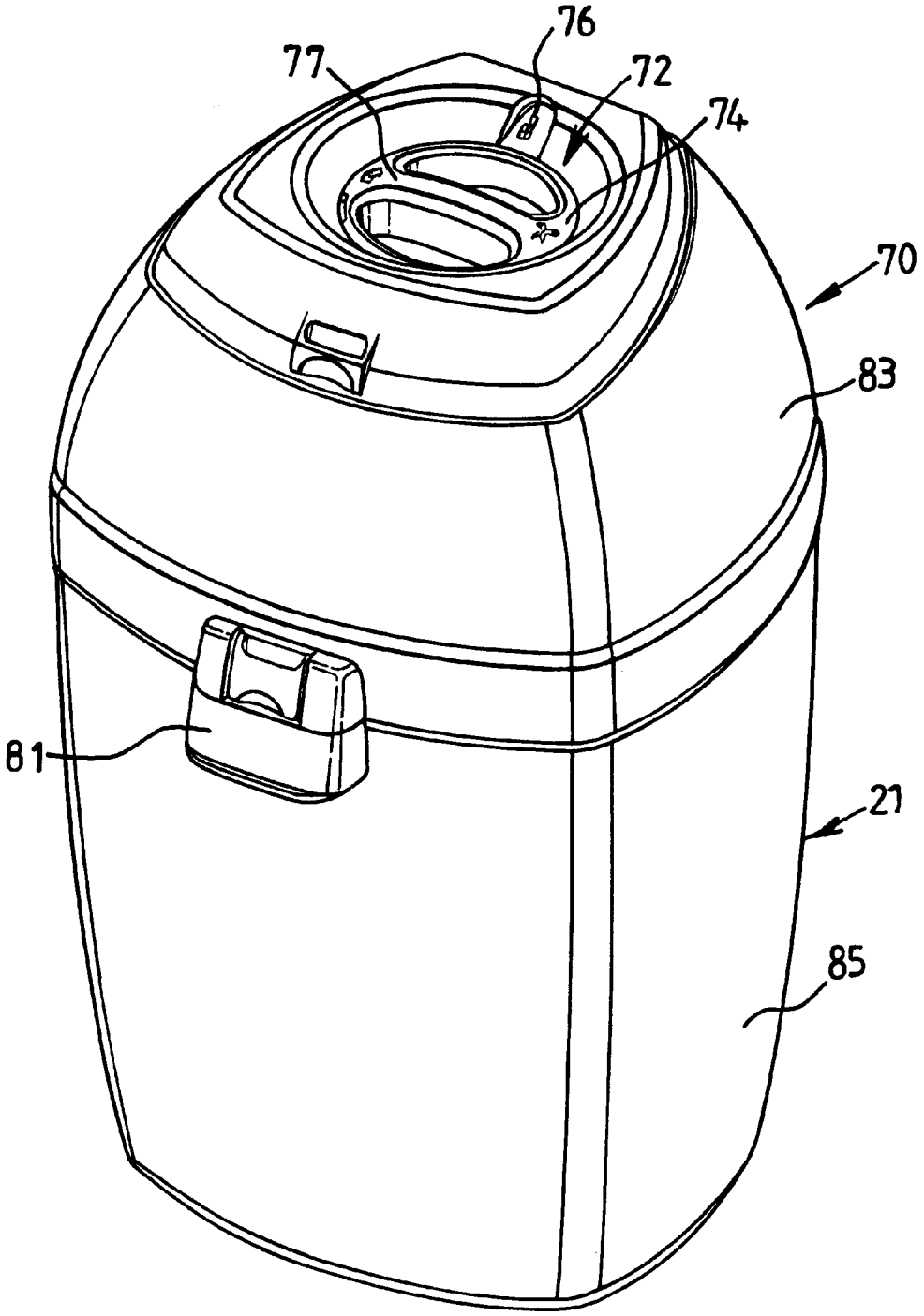
FIG. 7*a* is a perspective view of the embodiment of FIG. 4 in a second configuration.
Figure 7B:
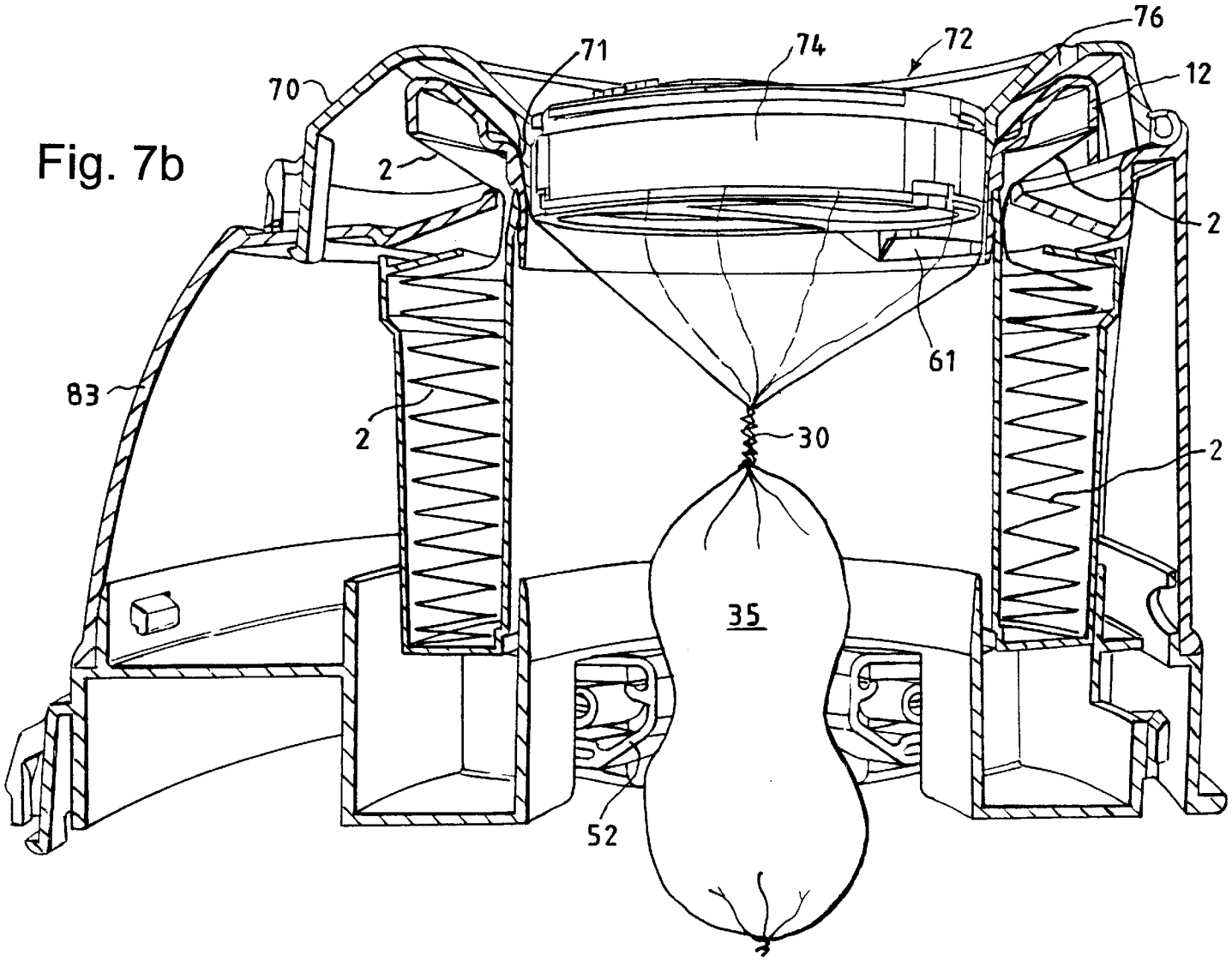
FIG. 7*b* is a sectional view corresponding to FIG. 7*a*.

The severing arrangement 72 is best understood with reference to FIGS. 5, 6 and 7*b*. The arrangement includes a ring 74 which is rotatably mounted on the lid 70 and received in a cylindrical flange 71 moulded integrally with the lid 70. The ring 74 is snap fitted onto the lid 70 and held in place, but free to rotate, in a keyway channel, such that an annular ridge projecting from the ring 74 is received in a cooperating circumferential channel in the flange 71. The ring 74 further includes inwardly radially projecting finger pieces 75 allowing manual rotation of the ring. Alternatively, as shown in, for example, FIG. 7*a*, a central cross bar 77 may be provided across the ring 74 for manual rotation.

Projecting from the underside of the ring 74 is a cutter unit 61 including a tapered shoe and cutter blade, of the type described in relation to FIG. 3 above.

The arrangement further includes a temper-proof catch or detent means 76 arranged to releasably fix the ring 74 against rotation. In the embodiment shown the catch 76 includes a resilient tab 78 attached at its lower end to the lid 70 and having a tongue 80 projecting from its upper end. The tab 78 can be integrally moulded with the lid 70, or flexibly mounted in any suitable manner. The tab 78 is biased radially inwardly into engagement with the periphery of the ring 74 and the ring 74 includes one or more indents 82 around its periphery arranged to engage with the tongue 80 and hold the ring 74 against rotation. The tab 78 includes a pressure portion 84 extending generally away from the ring 74. When manual pressure is applied to the pressure portion 84 the tab 78 flexed outwardly away from the ring 74, the tongue 80 disengages the indent 82 and the ring can be rotated. Once the catch 76 is released, the ring is free to rotate until the tongue 80 slips into the next indent 82 under the bias of the tab 78.

The lid 70 and severing arrangement 72 are generally configured such that when the lid 70 is hinged to its closed position the cylindrical flange 71 engages the inside of the funnel as a taper fit. The lid 70 is also of sufficient dimension to enclose the whole of the funnel 12 in its closed position. The lid 70 can be held in the closed position by suitable detent means 86, releasable to allow the lid 70 to be opened. As a result the whole of the inside of the device can be closed off in a secure and tamper proof manner.

In operation, when it is desired to place an object in the device, the lid 70 is hinged open, the object is pushed down into engagement with the springs 52 and the funnel 12 is twisted to form a twisted closure 30 as described above with reference to FIGS. 1 to 3; in particular forming a cone of flexible tubing. The lid 70 is then closed and the flange 71 locks into engagement with the inside of the funnel 12, securely closing the device against the escape of odours. The flexible tubing is held captive between the flange 71 and the funnel 12 and is also held taut by virtue of the engagement of the package 35 with the springs 52.

When it is desired to sever the flexible tubing, the catch 76 is depressed to release the ring 74, and the ring 74 is rotated by manual pressure applied to the finger pieces 75. The cutter unit then operates as discussed in relation to FIGS. 1 to 3 above the cutter engaging with a crease in the flexible tubing cone, feeding the tubing to the knife edge and severing it, the flange 71 holding the funnel, and hence the pack, against rotation. When the tubing has been severed the catch 76 is released and the ring 74 is further rotated until the tongue 80 slips into engagement with the next indent 82.

As a result an improved waste storage system is provided. Because the severing arrangement is mounted in a lid attached to the main body, there is no risk that it might be misplaced. Positioning of the severing arrangement is made simple as it is automatically located as the lid is hinged closed by the taper fit of the surrounding cylindrical flange with the inside of the funnel, and the number of steps in the cutting operation is reduced. Operation of the severing arrangement is simplified as it is not necessary to hold manually the pack itself against rotation—this is achieved automatically by the fixed lid engaging the pack. Furthermore the severing step is carried out entirely hygienically as the whole of the interior of the waste storage device is closed off by the lid.

Referring once again to FIG. 4, according to which the container 21 comprises an upper part 83 and a lower part 85 held together by a catch 81 and any suitable detachable hinge means (not shown), a modular waste storage device is also provided. In particular it will be noted that the upper portion 83 of the container 21 includes all of the working parts of the device including the cassette 2, springs 52, lid 70 and severing arrangement 72. Accordingly it is possible to use the device in modular form according to which the upper portion 83 can be attached to any suitable lower part. For example a larger bin-type lower part can be provided for commercial requirements in which large amounts of waste are required to be stored. Alternatively the upper portion 83 can be connected, for example, to a work surface having a suitable aperture for receiving waste.

It will be appreciated that the invention may be applied to alternative waste disposal device configurations—for example without any funnel in place or an arrangement such as that set out in International Patent Application No. PCT/GB 97/02768 including an additional collector bag for receiving the individual packages 35. The specific details of the cutting unit can of course be varied as appropriate. The lid need not be hinged but can be movably fixed to the container in any other appropriate manner.

The embodiments of the invention illustrated in the drawings are intended to be merely illustrative of the invention, and are not intended to limit the invention in any way.

Numerous modifications and alterations can be made to the devices shown in the drawings without departing from the principles underlying the invention, and all such modifications and alterations are intended to be embraced by the claims appended hereto and equivalents thereof

What is claimed is:

1. A waste storage device comprising a main body and a lid, the main body including a waste aperture inlet arranged to receive a storage bag, means for moveabley fastening the lid to the main body for movement between an open position during which said storage bags are filled and a closed position wherein the interior of the main body is sealed, the lid comprising storage bag severing means movably mounted thereon for cutting said storage bags during said closed position and a formation arranged to hold the storage bag against movement relative to the lid when the lid is in a closed position for operation of the severing means.

2. A waste storage device as claimed in claim 1, in which the lid is guided between said open and closed positions by the movable fastening.

3. A waste storage device as claimed in claim 2, in which the lid is hinged to the main body.

4. A waste storage device as claimed in claim 1, in which the waste inlet aperture includes an outwardly flared upper end closed by the lid in the closed position.

5. A waste storage device as claimed in claim 1, in which the lid further includes detent means releasably fixing the severing means against movement relative to the lid.

6. A waste storage device as claimed in claim 1, claimed in which the severing means is rotatably mounted on the lid.

7. A waste storage device as claimed in claim 1, in which the formation on the lid is arranged to hold the storage bag against the waste inlet aperture in the closed position.

8. A waste storage device as claimed in claim 1, in which the storage bag is formed from a length of flexible tubing drawn from a pack as waste is thrust through the waste inlet aperture, the pack being rotatable relative to the main body to form a closure about the waste by twisting.

* * * * *

UNITED STATES PATENT AND TRADEMARK OFFICE

CERTIFICATE OF CORRECTION

PATENT NO. : 6,128,890

DATED : October 10, 2000

INVENTOR(S) : Robert Firth

It is certified that error appears in the above-identified patent and that said Letters Patent is hereby corrected as shown below:

Title page, item [73], should read--

--Assignee: Melrose Products Limited
Guernsey, Channel Island--

Signed and Sealed this

Fifteenth Day of May, 2001

*Attest:*

NICHOLAS P. GODICI

*Attesting Officer*

*Acting Director of the United States Patent and Trademark Office*